US010731351B2

(12) United States Patent
Manasterski et al.

(10) Patent No.: US 10,731,351 B2
(45) Date of Patent: Aug. 4, 2020

(54) HIP VENT

(71) Applicant: Building Materials Investment Corporation, Dallas, TX (US)

(72) Inventors: Tim Manasterski, Cumming, GA (US); Walter Zarate, Prospect Park, NJ (US); Sudhir Railkar, Wayne, NJ (US); Jeffrey Avitabile, Lodi, NJ (US); Peter Campbell, Wanaque, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/561,432

(22) Filed: Dec. 5, 2014

(65) Prior Publication Data

US 2015/0159378 A1 Jun. 11, 2015

Related U.S. Application Data

(60) Provisional application No. 61/912,823, filed on Dec. 6, 2013.

(51) Int. Cl.
*E04D 13/17* (2006.01)
*F24F 13/08* (2006.01)

(52) U.S. Cl.
CPC ..... *E04D 13/174* (2013.01); *E04D 13/176* (2013.01); *E04D 13/17* (2013.01); *F24F 13/08* (2013.01)

(58) Field of Classification Search
CPC ..... E04D 13/174; E04D 13/176; E04D 13/17; F24F 7/02

(Continued)

(56) References Cited

U.S. PATENT DOCUMENTS 3,660,955 A * 5/1972 Simon ..... E04D 1/30 454/365
4,754,589 A * 7/1988 Leth ..... B28B 5/04 49/475.1

(Continued)

FOREIGN PATENT DOCUMENTS

DE 3511798 A1 * 12/1985 ..... E04D 13/174

OTHER PUBLICATIONS

"Hip Master" MidAmerica. The Tapco Group. 2015.

(Continued)

*Primary Examiner* — Basil S Katcheves
*Assistant Examiner* — Omar F Hijaz
(74) *Attorney, Agent, or Firm* — Womble Bond Dickinson (US) LLP

(57) ABSTRACT

A vent is disclosed that is particularly suited to use in ventilating attic spaces beneath a hip roof. The vent is configured to be installed along a hip of the roof overlying and covering a ventilation slot formed through the roof deck along the hip. The vent includes an elongated laterally flexible top panel from which baffle arrays depend. The baffle arrays are formed of a plurality of depending arcuately curved vanes that arc away from the vent. The vanes are aerodynamically shaped to redirect wind-blown rain and snow away from the vent and are configured to block the migration of rain and snow through the vent. A pair of spongy conformable filler strips is attached beneath the edge portions of the vent. The filler strips conform to the shapes of underlying shingles when the vent is installed to fill any gaps that otherwise might be formed between the vent and the shingles. A weather filter drapes over some of the baffle arrays to allow attic air to pass but prevent ingress of blown snowflakes and raindrops.

13 Claims, 7 Drawing Sheets

(58) Field of Classification Search
USPC .... 52/14, 198, 199, 13, 57, 91.3, 94–97, 41, 52/42
See application file for complete search history.

(56) References Cited

U.S. PATENT DOCUMENTS

| | | | | |
|---|---|---|---|---|
| 4,907,499 | A * | 3/1990 | James | 454/365 |
| 5,009,149 | A * | 4/1991 | MacLeod et al. | 454/365 |
| 5,174,076 | A * | 12/1992 | Schiedegger | F24F 7/02 454/3 |
| 5,458,538 | A * | 10/1995 | MacLeod et al. | 454/365 |
| 6,233,887 | B1 * | 5/2001 | Smith | 52/199 |
| 6,308,472 | B1 * | 10/2001 | Coulton et al. | 52/198 |
| 6,966,156 | B2 * | 11/2005 | Dixon | 52/199 |
| D602,579 | S * | 10/2009 | Stone | D23/373 |
| 8,322,089 | B2 * | 12/2012 | Railkar et al. | 52/198 |
| 2004/0128920 | A1 * | 7/2004 | Sharp et al. | 52/57 |
| 2006/0079173 | A1 * | 4/2006 | Coulton et al. | 454/365 |
| 2006/0096189 | A1 * | 5/2006 | Pavlansky | E04D 13/174 52/198 |
| 2008/0287054 | A1 * | 11/2008 | Carlson | E04D 13/174 454/365 |
| 2009/0025316 | A1 * | 1/2009 | Coulton | F24F 7/02 52/199 |
| 2009/0130969 | A1 * | 5/2009 | Grisham et al. | 454/260 |
| 2010/0144266 | A1 * | 6/2010 | Lowe | F24F 7/02 454/365 |
| 2014/0308891 | A1 * | 10/2014 | Holland et al. | 454/365 |

OTHER PUBLICATIONS

"Hip Ridge Vent." Air Vent Inc. http:www.airvent.com/professional/products/ridgeVents-hipridge.shtml. Feb. 24, 2015.
"SmartRidge II: Hip & Ridge Vent." DCi.

* cited by examiner

45°

WDR-@45°

| W + R Velocity | Infiltration |
|---|---|
| 35 MPH | 0 ml |
| 70 MPH | 0 ml |
| 90 MPH | 0 ml |
| 110 MPH | 0 ml |

90°

WDR-@90°

| W + R Velocity | Infiltration |
|---|---|
| 35 MPH | 0 ml |
| 70 MPH | 0 ml |
| 90 MPH | 0 ml |
| 110 MPH | -20 ml |

0°

WDR-@0°

| W + R Velocity | Infiltration |
|---|---|
| 35 MPH | 0 ml |
| 70 MPH | 0 ml |
| 90 MPH | 0 ml |
| 110 MPH | -25 ml |

HIP VENT

REFERENCE TO RELATED APPLICATION

Priority is hereby claimed to the filing date of U.S. provisional patent application No. 61/912,823 entitled Hip Vent, which was filed on Dec. 6, 2013. The entire content of this provisional patent application is hereby incorporated by reference as if fully set forth herein.

TECHNICAL FIELD

This disclosure relates generally to attic ventilation and more specifically to shingle-over vents for installation along a hip and/or along a ridge of a shingled roof.

BACKGROUND

Ridge vents and hip vents for ventilating a shingled roof have been known and used for many years. Such vents generally are installed along a ridge or along a hip of a roof covering a pre-cut ventilation slot to the attic below. It is inherently more difficult to seal a hip slot against ingress of blowing rain and snow because, among other reasons, of the angled nature of the hip and the angled down-slope directions away from the hip. Hip vents available in the past have had various inherent problems in this regard, particularly when it comes to their ability to prevent water infiltration beneath the vent and into a ventilation slot below.

One prior art hip vent for instance features an intricate baffle and foam insert design to block weather from entering the hip slot. Due to its intricate design and water protection features, it provides for low ventilation of the attic space below. Also, during installation of the vent, large gaps can result between the vent and the varying profile of hip cap and adjacent shingles. This is particularly true for roofs covered with architectural shingles, which are highly textured and exhibit large variations in thickness. According to the prior art, these gaps must be filled with caulking to provide a sufficient seal between the plastic base of the hip vent and the shingles in order to prevent water infiltration. For hip roofs shingled with high profile thick shingles, the amount of caulking required to seal the system can be very large and can actually promote leakage over time or if not carefully applied and maintained. Also, the high profile (i.e. the thickness) of this prior art vent does not provide for an aesthetically pleasant hip roof.

Another prior art hip vent features a blade or fin arrangement intended to provide seal between the vent and the underlying shingles along the hip of a roof. However, the fins alone do not completely seal between the hip vent and the shingles below and extensive amounts of caulking can still be required to obtain a good seal. A third prior art hip vent features a design that allows for little ventilation of attic space below due to its having very limited NFA (Net Free Area). This design also requires large amounts of caulking to prevent water infiltration into a hip slot beneath the hip vent.

A need exists for an attic vent usable along the hip of a hip roof that is easily installable without the need for caulking, even for roofs with thick profiled architectural shingles; that provides for a low profile (i.e. a thinner) aesthetically pleasing vent when installed; and that effectively redirects wind-blown water and snow thereby preventing water and snow penetration beneath the vent, even during blowing rain or blowing snow. It is to the provision of such a hip vent, which also may be used as a ridge vent if desired, that the present invention is primarily directed.

SUMMARY

A low-profile shingle-over hip vent is disclosed for installation along the hips of a hip roof covering a ventilation slot cut along the hip to the attic space below. The hip vent and ventilation slot below provide attic ventilation on hip roofs where there are no or inadequate horizontal ridges along the top of the roof to provide the desired ventilation. The hip vent includes baffle arrays, filler strips, and a weather filter that provide maximum resistance to infiltration of rain and snow while the hip vent itself remains thin and aesthetically pleasing on the finished roof. The need for extensive caulking is eliminated, which reduces further the chances of leakage if the calking is not applied correctly or deteriorates over time. These and other features, aspects, and advantages will become more apparent upon review of the detailed description set forth below taken in conjunction with the accompanying drawing figures, which are briefly described as follows.

DETAILED DESCRIPTION

Reference will be made throughout the following detailed description to the annexed drawing figures that are briefly described above.

Figure 1:
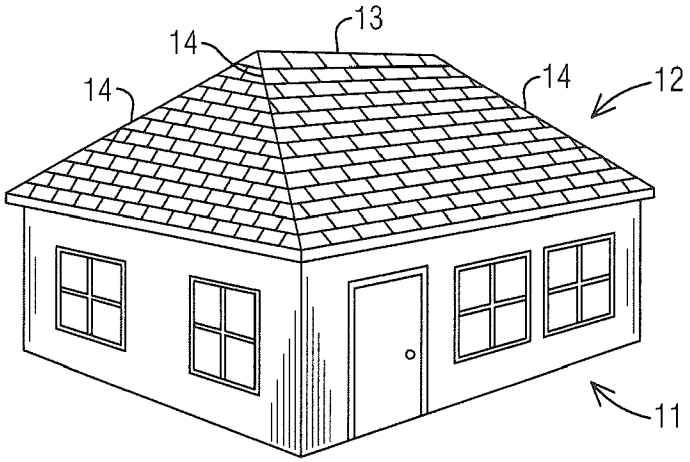
FIG. 1 is a perspective illustration of a home with a hip roof showing the hip areas extending downwardly from the ridge of the roof to the bottom corners of the roof.

FIG. 1 shows a building 11, a residential home in this case, having a hip style roof 12. The hip roof in this embodiment has a horizontally extending ridge 13 and four hips 14 that extend downwardly from the ends of the ridge to the lower corners of the roof. In such a roof, the extent of the ridge 13 is insufficient to provide the required amount of ventilation for the attic space below or to match the ventilation area of corresponding eave vents. Accordingly, additional ventilation can be provided by cutting vent slots along the hips 14 and applying hip vents over the vent slots.

Figure 2:
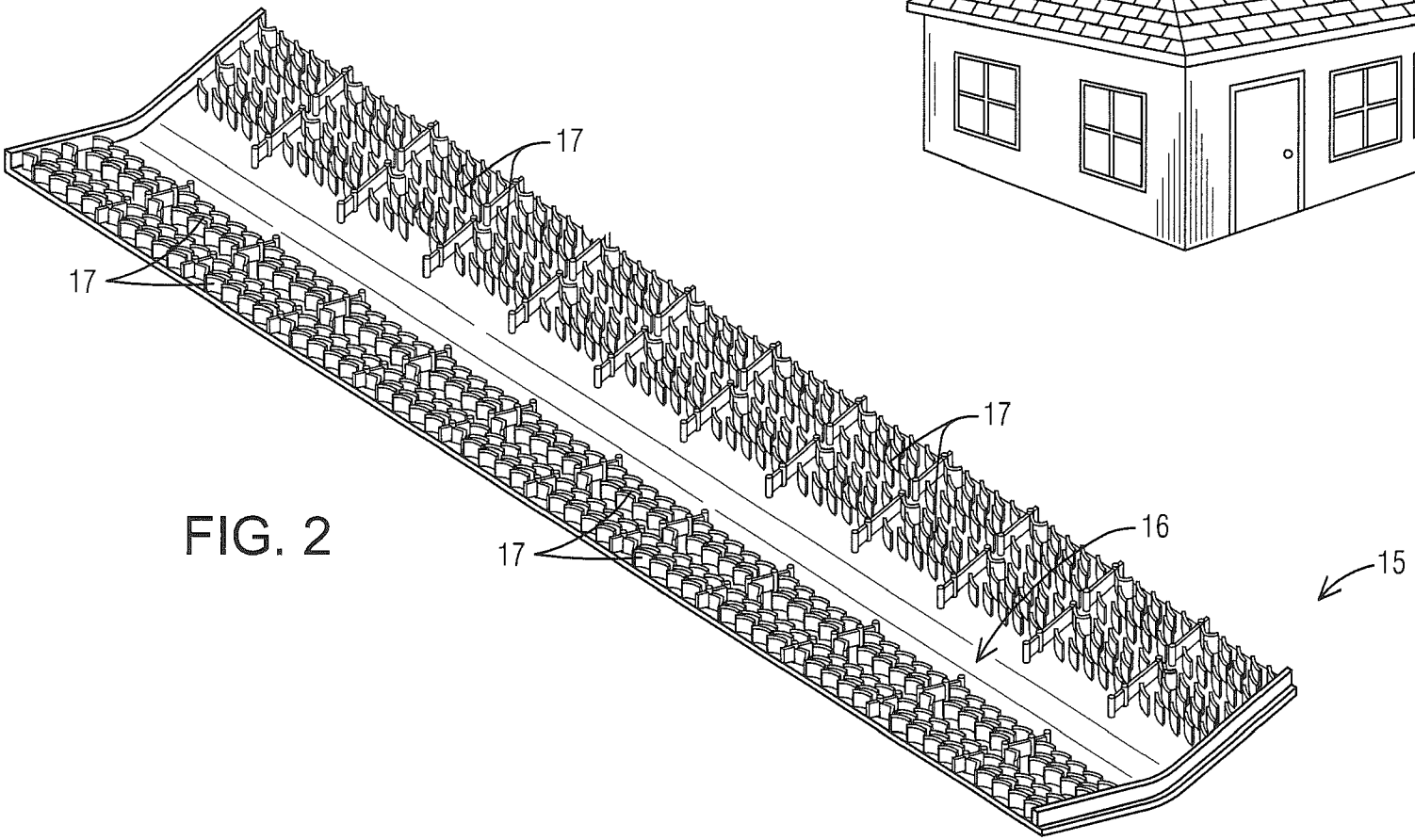
FIG. 2 is a perspective bottom view of a hip vent section that embodies principles of the invention in one preferred form.

The hip vent of the present invention is configured to be installed along the hips 14 covering a hip slot formed therealong to provide ventilation of an attic space below the roof. FIG. 2 shows the hip vent of this invention from the bottom side thereof. The hip vent 15 preferably is made of injection molded plastic and generally comprises a laterally flexible top panel 16 with baffle arrays 17 projecting from the underside of the panel along its edge portions. The baffle arrays are comprised of arcuate vanes and walls, which will be described in more detail below. Generally, the vanes are configured to allow attic air to pass out while redirecting windblown rainwater and snow away from the vent and thus to preventing rainwater and snow from entering the attic through the hip slot below the hip vent 15. As detailed below, provisions also are made according to the invention for preventing insects and debris from entering the attic beneath the installed hip vent. The hip vent 15 preferably is provided in standard lengths such as four feet and includes features at its ends for attaching the vents together end-to-end to form longer runs of hip vent.

Figure 3A:
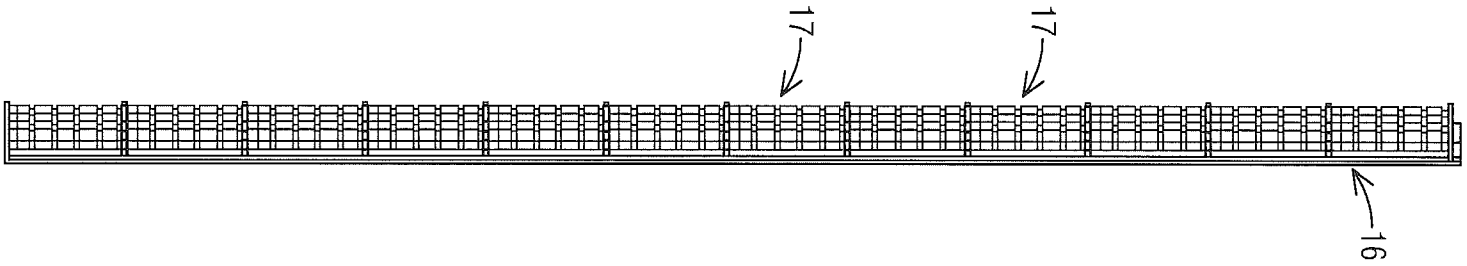
FIGS. 3*a*-3*c* show a side, top, and bottom view respectively of the hip vent shown in FIG. 2.
Figure 3B:
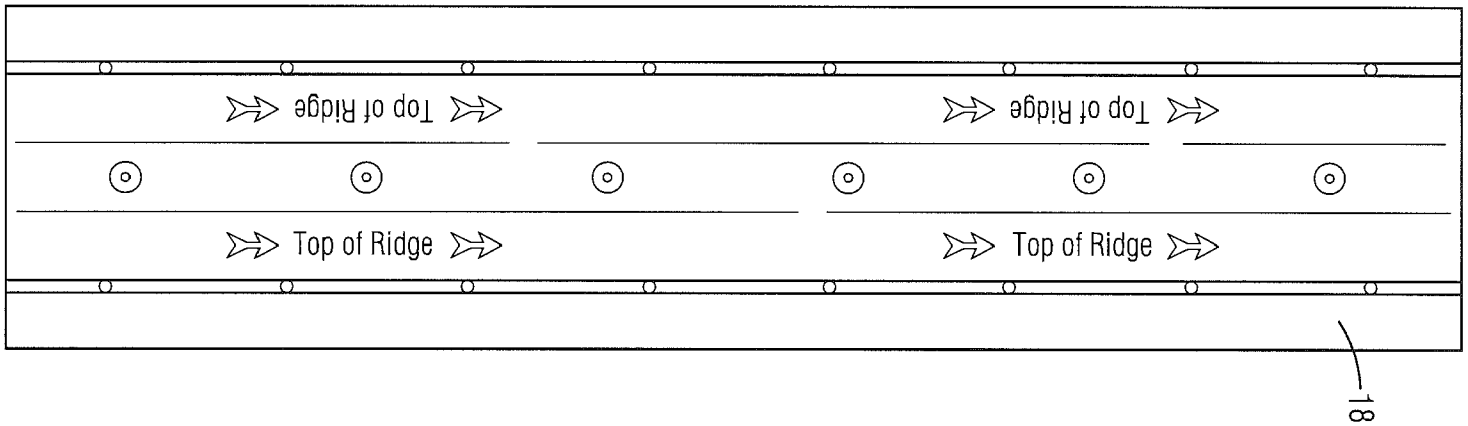
Figure 3C:
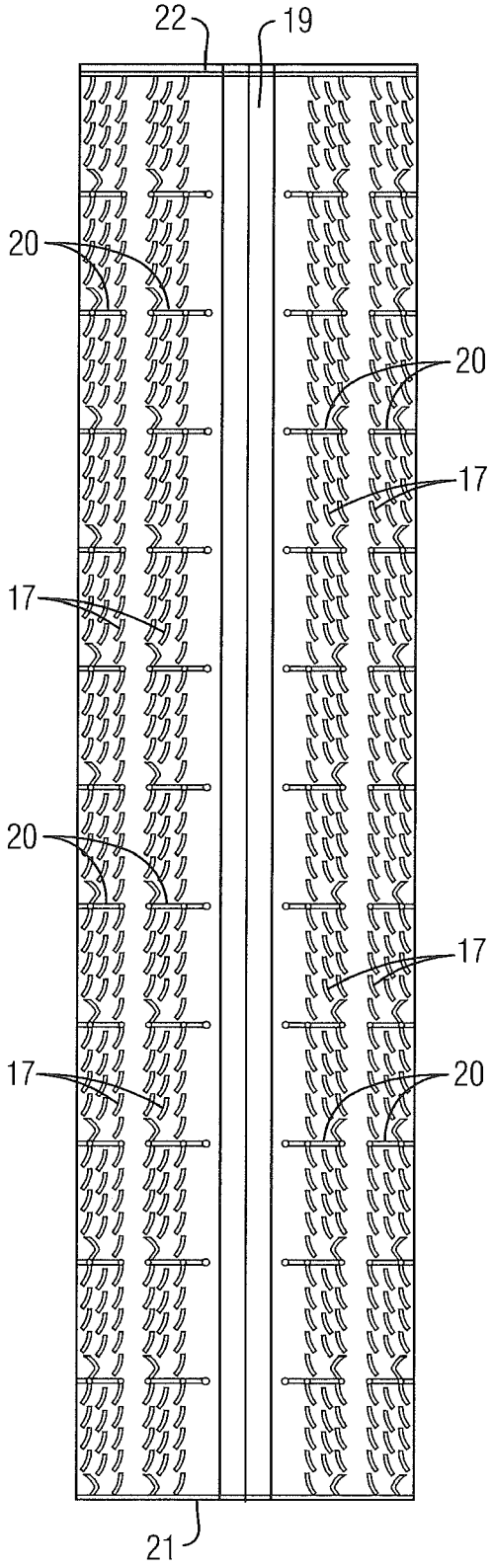

FIGS. 3*a*-3*c* show, from left to right, an edge view of the hip vent of the invention, a top plan view of the hip vent, and a bottom plan view of the hip vent. The laterally flexible top panel 16 and depending baffle arrays 17 can be seen in the edge view as they would be presented to windblown rain or snow on a roof. The vent is substantially thinner than prior art hip vents to provide a more aesthetically pleasing low profile appearance on a roof. This is particularly important for hip vents, which can be more visible from a distance than a traditional ridge vent. The top view of FIG. 3*b* illustrates the upper surface 18 of the laterally flexible top panel 16, which may be embossed with various lines, nailing locations, and indicia to aid an installer during installation of the hip vent.

Figure 4:
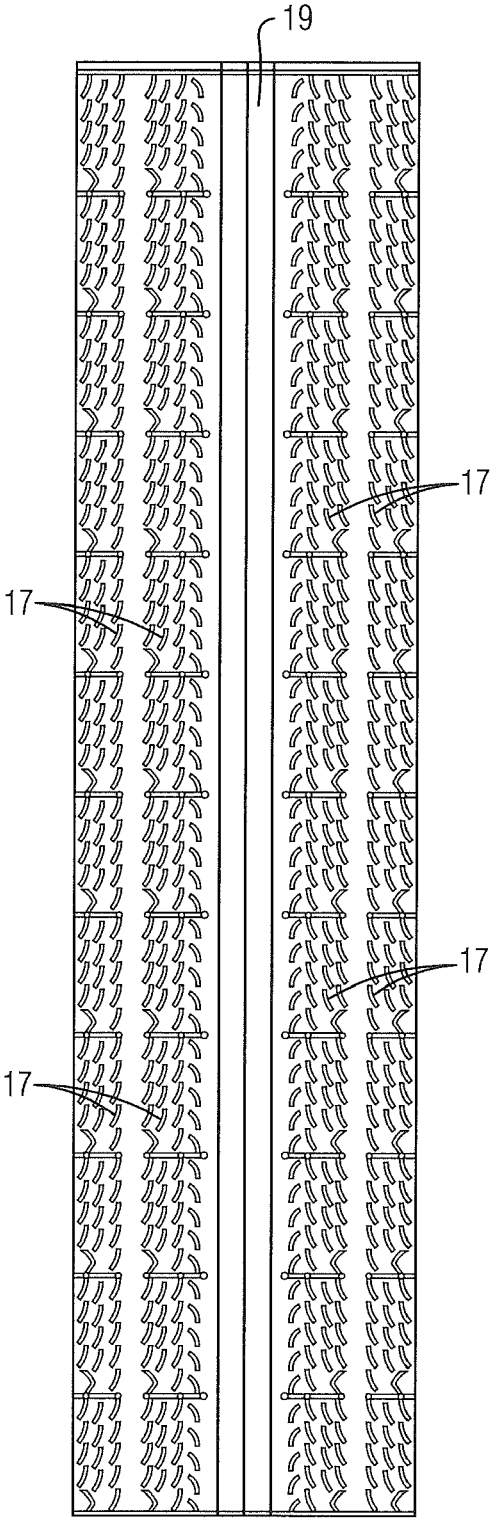
FIG. 4 is a more detailed bottom plan view of the hip vent of FIGS. 2 and 3 showing various elements of the weather resistant baffle array structure.

The bottom view of FIG. 3*c* illustrates the lower surface 19 of the laterally flexible top panel 16 and again shows the baffle arrays 17 and barrier walls 20 extending along the left and right edge portions of the panel. The barrier walls 20 separate the baffle arrays from each other, form wind brakes, and are configured to rest on a shingled roof below to support the hip a predetermined distance above the roof. Weather barriers 21 and 22 may be provided at the ends of the hip vent extending downwardly from the top panel 16 to prevent infiltration of rain water from the ends. Mating connector structures also may be provided on the ends so that a plurality of hip vents can be installed in end-to-end relationship and will be water resistant at their junctions. FIG. 4 also shows the bottom of the hip vent with the lower surface 19 and baffle arrays 17 visible.

Figure 5:
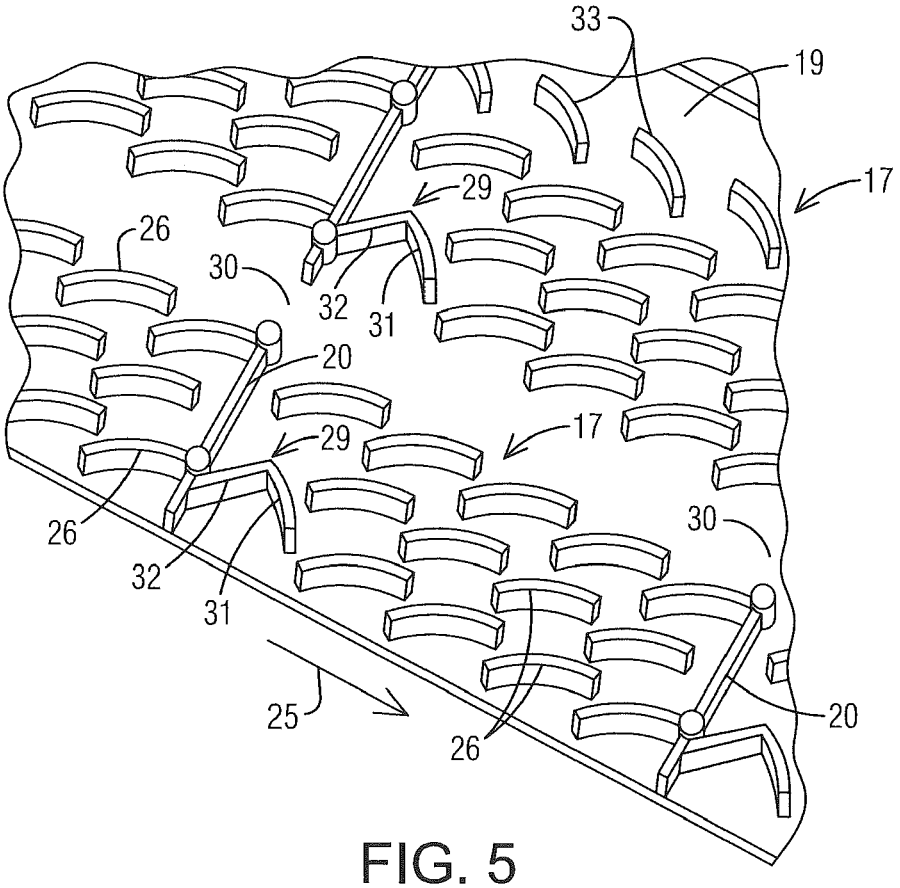
FIG. 5 is an enlarged view of a portion of the bottom of the hip vent of FIG. 4 illustrating more details of the baffle array structure.

FIG. 5 illustrates one preferred embodiment of the baffle arrays of the hip vent, which are designed with an aerodynamic shape to deflect rainwater away from the vent and onto the sloped roof when installed. The vanes also are configured to help prevent wind-blown rain from blowing through the baffle arrays and leaking into an attic space through the ridge slot. In FIG. 5, the up slope direction when the hip vent is installed is indicated by arrow 25. Each of the baffle arrays 17 comprises a plurality of curved vanes 26 that arc downwardly and outwardly when the hip vent is installed on a roof. The arcuate vanes of each array are spaced relative to each other so that no straight uninterrupted path is formed from the outside edge of the hip vent through the array of vanes. Further, the lower ends of the vanes in each row of vanes overlap slightly the upper ends of the next downslope vane of the row. In this way, water that may seep or be blown past the lower end of one vane is likely to encounter the next downslope vane and be shed away from the hip vent by that vane. An additional row of vanes 33 that curve in the opposite direction are arranged along the inner edge of the inner array.

Each baffle array 17 is bounded at its upslope end by a barrier wall 20 and bounded at its downslope end by a barrier wall 20, each of which extends generally transversely relative to the hip vent. These barrier walls enhance the structural integrity to the hip vent, provide wind brakes between the baffle arrays, and help to support the vent and prevent it from collapsing when installed on a hip roof with nails or other fasteners. Each of the barrier walls 20 comprises an inner portion adjacent the center of the central panel and an outer portion adjacent the edges of the central panel. The inner and outer portions of the barrier walls are separated by gaps 30 for purposes described in more detail below.

The outermost and lowermost vane 29 of each baffle array in this embodiment has an arcuate portion 31 that is oriented substantially transverse to the orientations of the arcuate vanes 26 and a straight portion 32 that extends from the inner end of the arcuate portion 31 to connect integrally to the barrier wall 20. This insures that there is no free path for water to be blown beneath the hip vent along the upslope sides of the barrier walls. The downslope sides of the barrier walls have arcuate vanes 27 integrally connected to and extending therefrom so that no path for water is formed along the downslope sides of the barrier walls either.

Figure 6:
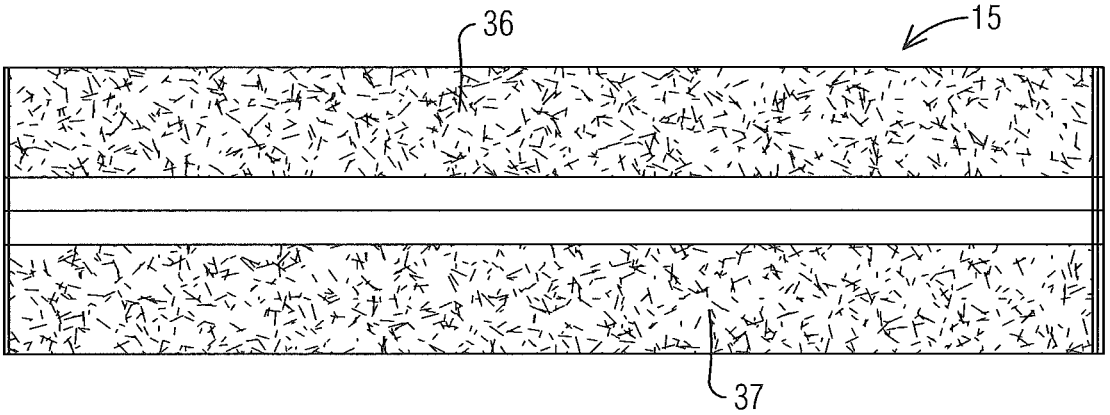
FIG. 6 is a bottom plan view of a hip vent according to the invention showing a pair of bottom filler strips attached thereto according to an embodiment thereof.

FIG. 6 illustrates another aspect of the hip vent 15 of the present invention; namely, a pair of filler strips 37 is attached to and extend along the bottoms of the baffle arrays. The filler strips are constructed of a spongy conformable material such as a mat of non-woven polymer strands, foam, or other material that is sufficiently conformable to a surface. When installing the hip vent 15 along the hip of a roof, gaps can result between the shingles of the roof and the bottoms of the baffle arrays. This is particularly true for roofs shingled with highly textured and layered architectural shingles, which are popular among homeowners. Rainwater and snow can be blown through these gaps and can leak through the hip slot into the attic below. The filler strips 37 address this issue by conforming to the uneven top surfaces of the shingles on either side of the hip when the hip vent is installed. Any would-be gaps are thus filled by the filler strips to block rainwater from seeping through. An additional advantage of the filler strips is that, unlike prior art hip vents, no caulking is required during installation to fill gaps between the hip vent and the shingles of the roof. This eliminates installation errors and erosion over time that can result in leaks.

Figure 7:
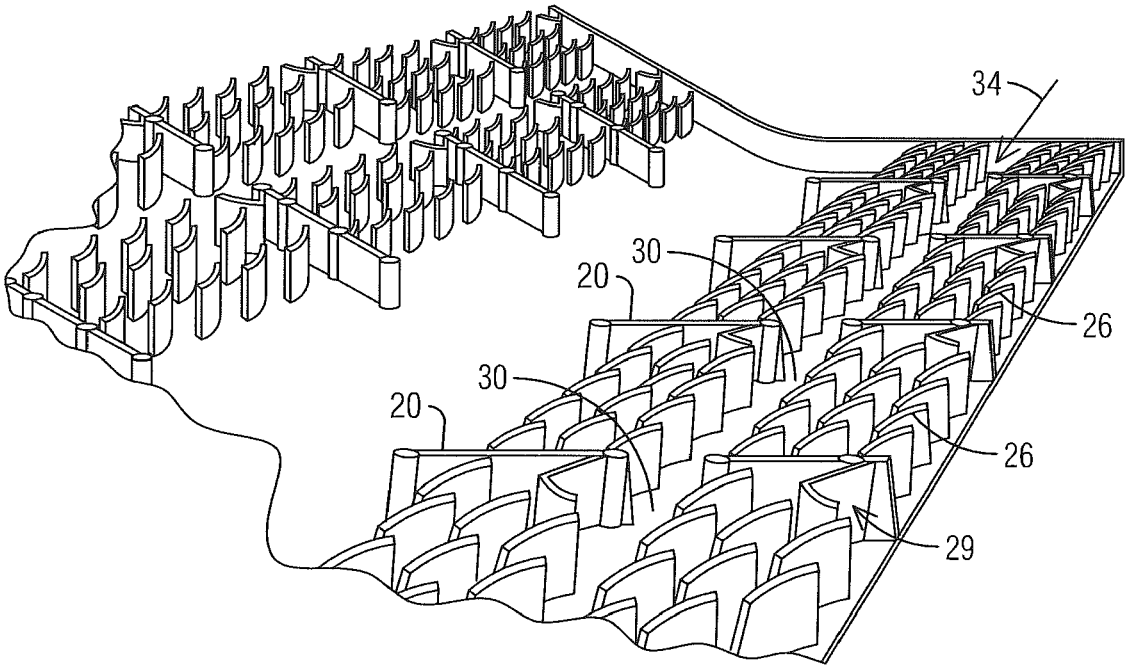
FIG. 7 shows a portion of the underside of the hip vent of this invention seen from another angle and further illustrating the baffle array.
Figure 8:
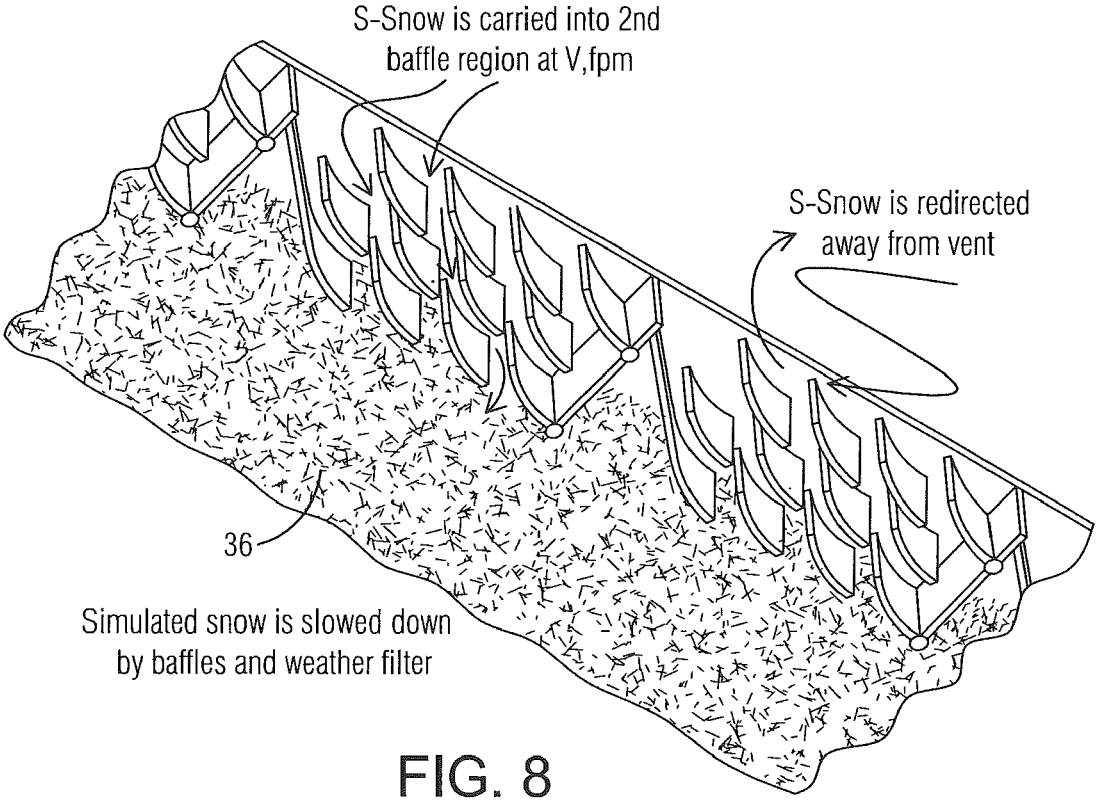
FIG. 8 is a perspective enlarged view of one edge of the hip vent showing a preferred method of attaching an air permeable weather filter to the bottom portion of the hip vent.

As perhaps best shown in FIG. 7, the baffle arrays 17 are arranged along each edge portion of the hip vent in two rows that are spaced apart from each other to define a longitudinal gap indicated by arrow 34. Further, each baffle array itself preferably comprises three rows of arcuate vanes spaced as described above so that no straight uninterrupted path for water is defined through the array. The gap 34 divides the baffle arrays into two regions, an outer region and an inner region and the gaps 30 in the barrier walls 20 align with the gap 34. As shown in FIG. 8, a mesh made of air permeable non-woven polymer vent material 36 is draped over the baffle arrays of the inner region and is welded, heat staked, or otherwise attached along the insides of these baffle arrays and on the outsides within the gap 34. This forms a weather filter encasing the inner regions of the baffle arrays through which attic air can pass out but through which wind-blown rain and snowflakes cannot pass in.

Figure 9:
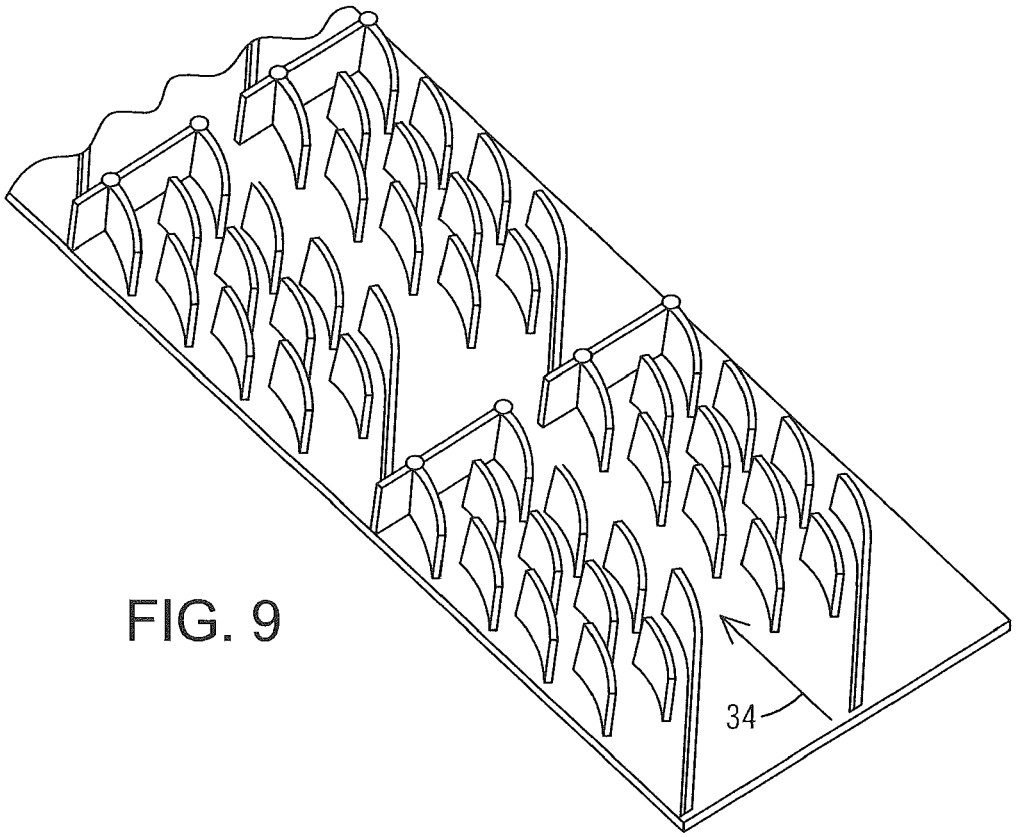
FIG. 9 is a perspective enlarged view of a portion of the bottom of the hip vent illustrating the weather filter weld area where the weather filter is attached.

The weather filter 36 is particularly effective for stopping wind-blown snow. Snowflakes behave differently than rainwater in that they can be blown around the arcuate vanes of the baffle arrays and make their way toward the hip slot. With the weather filter 36 in place, any snowflakes that make it through the baffle arrays of the outer region are entangled and trapped within the material of the weather filter and do not penetrate through the baffle arrays of the inner region. Eventually these snowflakes melt and drain away from the hip of the roof. In addition, some snowflakes are redirected away from the vent by the aerodynamic shape of the arcuate vanes in the outer region. This combination has proven to provide a robust and reliable barrier against infiltration of wind-blown snow into an attic space below. FIG. 9 also shows the gap 34 between the baffle arrays of the inner and outer regions where one edge of the weather filter is welded, heat staked, or otherwise attached.

Figure 10:
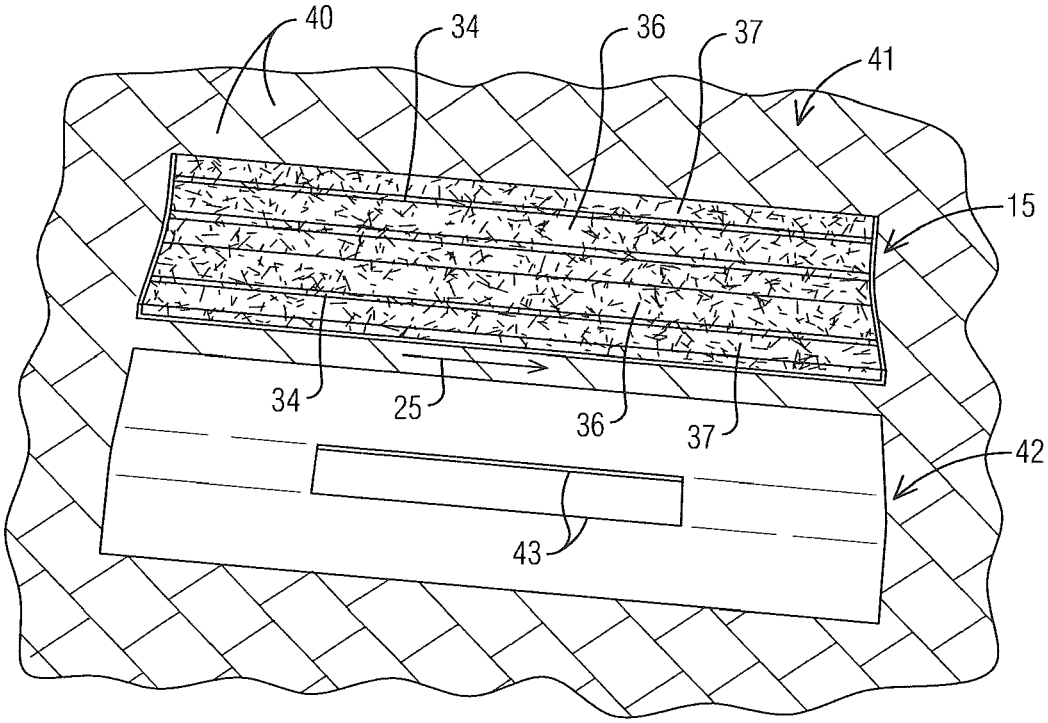
FIG. 10 shows a hip slot formed along a roof hip and a hip vent according to the invention lying next to the slot upside down with its weather filter attached.

FIG. 10 shows a hip roof 41 covered with shingles 40 and having a hip 42 sloping in the down-slope direction 25. A hip slot 43 is cut in the roof and extends along the hip to provide a ventilation path for the attic space below. Lying on the roof 41 next to the hip 42 is a hip vent constructed according to the present invention. The vent is shown upside down in FIG. 10. The weather filter 36 is shown draped over and welded in place covering the baffle arrays of the inner region. As mentioned, the weather filter 36 is welded or otherwise attached in the gaps 34 between the inner and outer regions of baffle arrays in such a way that the encase the inner baffle arrays. The weather filter also may be welded or otherwise attached to the underside of the flexible panel along the inner sides of the inner regions of baffle arrays. In this way, snow and/or rainwater must pass through two layers of the weather filter to reach the ridge slot 43 when the hip vent is installed. In fact, the weather filter may cover both the inner and outer baffle arrays if desired to provide an even more enhanced resistance to windblown rain and snow. Also seen in FIG. 10 are the two conformable filler strips 37 extending beneath each edge portion of the hip vent, where they are attached by welding, heat staking, or other appropriate attachment means.

The hip vent 15 shown in FIG. 10 is installed by being flipped over, positioned along the hip so that it straddles and overlies the hip slot 43, and attached to the roof deck on either side of the hip slot with fasteners such as nails. When so installed, the filler strips 37 compress against the shingles 40 and, due to the spongy nature of the filler strips, conform to the surfaces of the shingles. While standard three tab asphalt shingles are shown in FIG. 10, many roofs are shingled with much thicker and textured architectural shingles. In such installations, the filler strips can conform to radical differences in the heights of shingle surfaces thereby filling gaps that would be formed without the filler strips. It has been found that the filler strips eliminate the need for caulking to seal between the shingles and the edges of the hip vent.

Figure 11:
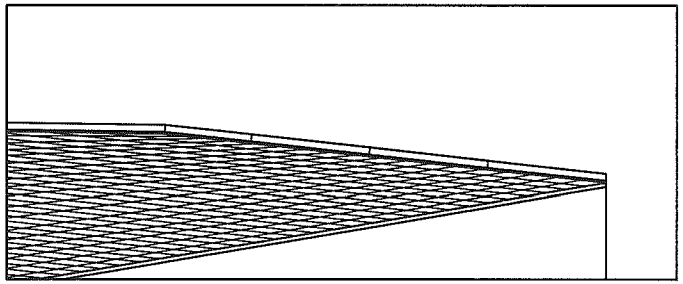
FIG. 11 illustrates the results of wind-blown rain testing of the hip vent of this invention and illustrates the vent's exceptional resistance to water penetration under severe storm conditions.
Figure 11:
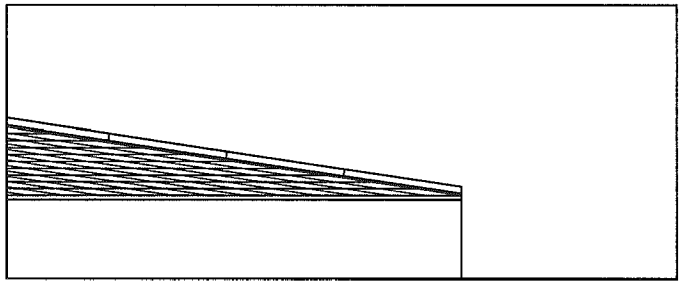
Figure 11:
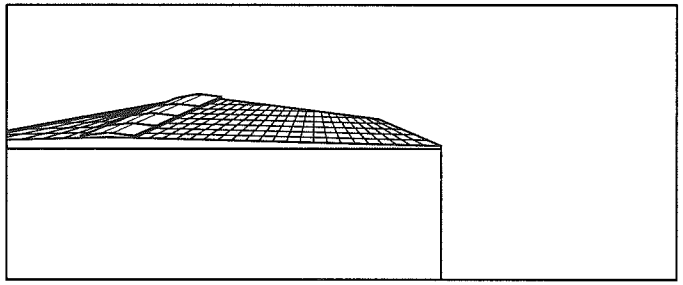

FIG. 11 shows the results of rain penetration testing of the hip vent disclosed herein. A hip vent according to the above disclosure was installed along the hip of a mock hip roof as described above. Simulated windblown rain was then directed from a rain machine toward the hip covered by the hip vent. The tests were conducted with rain blown at the hip from zero degrees (i.e. along the hip), forty-five degrees to the hip, and ninety degrees to the hip. At each of these angles, tests were conducted at wind speeds of 35, 70, 90, and 110 miles per hour as per Miami WDR TAS-100(a)-95 protocol. Any water that seeped into the space below the roof was collected and its volume measured. Miami WDR TAS-100(A)-95 protocol allows a maximum of 1500 ml of water for the vent to pass the test. As shown on the right in FIG. 11, only with 110 mph windblown rain did any water leak into the attic through the hip slot. Even then, the amounts were only 25 ml at zero degrees and 20 ml at 90 degrees. These amounts are considered in the industry to be negligible and fall well within the parameters for certification of attic ventilation products.

The invention has been described above within the context of preferred embodiments and methodologies considered by the inventors to represent the best modes of carrying out the invention. It will be understood by the skilled artisan, however, that a wide array of additions, deletions, and modifications, both subtle and gross, might be made to the example embodiments without departing from the scope of the invention itself. For instance, while the vent has been described as a hip vent for use along the hips of hip roofs, which is its intended use, there is no reason why it would not function perfectly well along the ridge of a gable or other type roof. The vanes of the baffle arrays in the preferred embodiment are circular arcs in shape. However, other shapes such as V-shaped, polygonal shaped, chevron shaped, spiral shaped, or other shapes might be used to obtain equivalent results. The disclosed hip vent may be used with or without the weather filter and with or without the filler strips depending upon application. For example, the weather filter may not be needed in areas of the country that do not experience snow storms or high velocity rain storms. The filler strips may not be needed when installing the hip vent on roofs with flat non-textured shingles (although filler strips are still considered by the inventors to be advisable). Further, the filler strips may be attached to the bottoms of hip vents either in the factory or in the field as needed. If installed in the field, they need only be attached with adhesive along the bottoms of the outer (and/or inner) wind baffle zones. As an alternative to the weather filter disclosed in the preferred embodiment, an air permeable insert may be formed and installed within and along the gap between the wind baffle zones. Such an insert may be made of recycled fibers, polymeric fibers, co-mingled fibers, natural fibers, mixtures of the forgoing, and layered or dual density material. Such inserts also may be formed with holes, passageways, or slots that allow air to flow but form barriers to windblown rain, snot, and insects. Finally, the hip vent of the preferred embodiment is made of injection molded plastic. It will be understood, however, that other materials such as metal may be substituted without departing from the spirit and scope of the invention. These and other modifications are possible, and all are intended to fall within the scope of the present invention.

The invention claimed is:

1. A hip roof having at least one hip sloping from an upper end in a downward direction to a lower end, the upper end being higher than the lower end, and a hip vent extending along and covering the hip, the hip vent comprising:

a laterally flexible top panel having a central portion, edge portions terminating at lateral edges of the laterally flexible top panel, an upslope end located adjacent the upper end of the hip, and a downslope end adjacent the lower end of the hip so that the vent slopes in a downward direction from a location adjacent the upper end of the hip toward the lower end of the hip;

a plurality of spaced barrier walls depending from the laterally flexible top panel and extending from the lateral edges of the laterally flexible top panel toward the central portion of the laterally flexible top panel;

baffle arrays depending from the laterally flexible top panel along the edge portions thereof, the baffle arrays comprising a plurality of spaced apart vanes extending from the laterally flexible top panel to bottom ends with no intervening material between the vanes and the laterally flexible top panel, the spaced apart vanes being configured and positioned to define a ventilation path for air through the baffle arrays while the vanes encounter and redirect rainwater and snow entering beneath the vent from its edge portions away from the vent and onto an adjacent sloped portion of the roof, at least some of the vanes not connected to any other structure depending from the bottom surface of the laterally flexible top panel;

each of the vanes of the baffle arrays being arcuate in shape to define a concave surface extending between a first terminal edge of the vane and a second terminal edge of the vane, each vane being oriented with respect to the laterally flexible top panel such that the first terminal edge of the vane is positioned nearer the upslope end and nearer the central portion of the laterally flexible top panel and the second terminal edge of the vane is positioned nearer the downslope end and nearer an adjacent lateral edge of the laterally flexible top panel, with the concave surface of each of the vanes facing the adjacent lateral edge so that the concave surface encounters rain and snow that may enter beneath the laterally flexible top panel;

the second terminal edges of at least some of the vanes overlapping the first terminal edges of an adjacent vane such that rain and snow that may blow past the second terminal edge of some vanes encounters the adjacent vane and is shed away from the hip vent by the adjacent vane; and filler strips attached to and extending along the bottom ends of the vanes, the filler strips extending from the bottom ends of the vanes away from the lateral flexible top panel so that they are not located in the ventilation path and being made of a material that conforms to uneven surfaces of roof shingles beneath the baffle arrays thereby filling and forming a seal between the bottom ends of the vanes and shingles below when the hip vent is installed.

2. A hip roof as claimed in claim 1 wherein the vanes of the baffle arrays are spaced and arranged such that no straight uninterrupted path for water or snow is defined through the baffle arrays from the lateral edges of the vent to the central portion of the vent.

3. A hip roof as claimed in claim 1 wherein the baffle arrays comprise an inner array of baffles and an outer array of baffles separated by a longitudinally extending gap.

4. A hip roof as claimed in claim 3 further comprising an air permeable weather barrier attached to and extending along one of the inner and outer arrays of baffles and being located in the ventilation path to encounter and arrest rain and snow attempting to travel through the baffle array.

5. A hip roof as claimed in claim 4 wherein the weather barrier comprises a non-woven material.

6. A hip roof as claimed in claim 5 wherein the non-woven material is draped over the inner or outer array of baffles and attached along opposing sides of the array to form a double wall barrier.

7. A hip roof as claimed in claim 1 wherein each of the baffle arrays comprises a plurality of baffle arrays separated by barrier walls.

8. A hip roof as claimed in claim 7 wherein the barrier walls extend substantially transversely with respect to the vent.

9. A shingle over hip vent for covering a ventilation slot cut along a sloped hip of a hip style roof to provide ventilation of an attic space below, the sloped hip sloping from an upper end in a downward direction to a lower end, the upper end being higher than the lower end, the hip vent comprising:

an elongated laterally flexible panel having a central portion, edge portions terminating at lateral edges of the panel, a top surface, a bottom surface, an upslope end to be located adjacent the upper end of the sloped hip, and a downslope end to be located adjacent the lower end of the hip so that the vent, when installed, slopes in a downward direction from the upslope end to the downslope end;

outer regions of baffles projecting from the bottom surface of the laterally flexible panel to lower ends, the outer regions of baffles extending along the edge portions of the laterally flexible panel adjacent the lateral edges;

inner regions of baffles projecting from the bottom surface of the laterally flexible panel to lower ends and being located inboard of the outer regions of baffles;

the outer and inner regions of baffles defining a ventilation path therethrough to allow attic air to flow through the baffles and be vented from the attic at the lateral edges of the panel, a longitudinally extending gap being defined between the outer and inner regions of baffles;

each region of baffles comprising a plurality of arcuate vanes;

each of the vanes in both of the outer and inner regions of baffles being arcuate in shape to define a concave surface extending between a first terminal edge of the vane and a second terminal edge of the vane, each vane being oriented relative to the central panel such that its first terminal edge is located a first distance from an adjacent lateral edge of the central panel and nearer the upslope end of the central panel and the second terminal edge of the vane is located a second distance from the same adjacent lateral edge of the central panel and nearer the downslope end of the central panel, the first distance being greater than the second distance, the concave surfaces of the vanes facing the adjacent lateral edge of the elongated laterally flexible panel so that all of the vanes upon encountering rainwater direct the rainwater along their concave surfaces urging the rainwater away from the central portion and the ventilation slot and toward the adjacent lateral edge when the hip vent is installed along a sloped hip;

a majority of the vanes not connected to any other structure depending from the bottom surface of the laterally flexible panel;

the second terminal edges of at least some of the vanes overlapping the first terminal edges of an adjacent vane such that rain and snow that may blow past the second terminal edge of some vanes encounters the first terminal edge of the adjacent vane and is shed away from the hip vent by the adjacent baffle;

a filler strip attached to and extending along the lower ends of at least one of the inner and outer regions of baffles, the filler strip extending from the lower ends of the baffles in a direction away from the laterally flexible panel with no part of the filler strip located in the ventilation path, the filler strip being made of a conformable material to conform to roofing shingles beneath the baffles when the hip vent is installed and thereby fill and form a seal between the roofing shingles and the baffles; and a plurality of barrier walls projecting from the bottom surface of the laterally flexible panel, the barrier walls extending substantially transversely relative to the laterally flexible panel and being interspersed among the outer and inner regions of baffles.

10. The shingle over hip vent claimed in claim 9 further comprising a weather barrier draped over each of the inner regions of baffles with part of the weather barrier being in the ventilation path, the weather barrier being air permeable but substantially impermeable to rain and snow.

11. The shingle over hip vent claimed in claim 10 wherein the weather barrier extends along opposed sides of the inner regions of baffles to form two air permeable barriers to rain and snow.

12. The shingle over hip vent claimed in claim 9 wherein the filler strip is made of entangled polymer fibers.

13. The shingle over hip vent claimed in claim 9 wherein the filler strip is made of a foamed material.

* * * * *